US011405717B2

(12) United States Patent
Smith et al.

(10) Patent No.: US 11,405,717 B2
(45) Date of Patent: Aug. 2, 2022

(54) PRESSURE EQUALIZING EARPHONE

(71) Applicants: Robert Smith, La Porte, IN (US); Casey Ng, Oakland, CA (US)

(72) Inventors: Robert Smith, La Porte, IN (US); Casey Ng, Oakland, CA (US)

(73) Assignee: Casey Kong Ng, Oakland, CA (US)

( * ) Notice: Subject to any disclaimer, the term of this patent is extended or adjusted under 35 U.S.C. 154(b) by 0 days.

(21) Appl. No.: 17/125,603

(22) Filed: Dec. 17, 2020

(65) Prior Publication Data

US 2021/0185429 A1 Jun. 17, 2021

Related U.S. Application Data

(60) Provisional application No. 62/949,407, filed on Dec. 17, 2019.

(51) Int. Cl.
*H04R 1/10* (2006.01)

(52) U.S. Cl.
CPC ..... *H04R 1/1091* (2013.01); *H04R 1/1016* (2013.01); *H04R 1/1041* (2013.01); *H04R 1/1083* (2013.01)

(58) Field of Classification Search
CPC .. H04R 1/1091; H04R 1/1016; H04R 1/1041; H04R 1/1083
See application file for complete search history.

(56) References Cited

U.S. PATENT DOCUMENTS 8,657,064 B2 * 2/2014 Staab ..... H04R 25/656 181/130
9,451,351 B2 9/2016 Smailagic et al.
2008/0002835 A1 * 1/2008 Sapiejewski ..... H04R 1/2849 381/71.6
2008/0253583 A1 * 10/2008 Goldstein ..... G06F 3/16 381/92

(Continued)

OTHER PUBLICATIONS https: //www.amazon.in/Roboster-Stereo-Earphone-Headphone-Headset/dp/B01N6TRL0L, date unknown, author unknown.

(Continued)

*Primary Examiner* — Simon King

(57) ABSTRACT

An earphone has a body housing a transducer that is capable of generating an acoustic signal and directing the acoustic signal to an outlet in the body, the body being positionable in, on, or near an ear of user so that the acoustic signal can be directed into the ear canal of the user. The earphone also has an ear coupling mechanism comprising a sealing mechanism with a sealing member that is adapted to contact a portion of the ear of the user to at least partially create a seal between the ear canal and the external environment and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism. The air conduit is sized and shaped so as to provide an improved audio performance over an earphone without the air conduit.

21 Claims, 4 Drawing Sheets

(56) References Cited

U.S. PATENT DOCUMENTS

2009/0067661 A1* 3/2009 Keady ..... H04R 1/1091 381/375
2010/0074451 A1* 3/2010 Usher ..... H04R 1/1091 381/58
2011/0058704 A1* 3/2011 Harlow ..... H04R 1/1058 381/380
2012/0039500 A1* 2/2012 Silvestri ..... H04R 1/02 381/380
2012/0039501 A1* 2/2012 Silvestri ..... H04R 1/1075 381/380
2013/0004004 A1* 1/2013 Zhao ..... H04R 25/656 381/328
2014/0270200 A1* 9/2014 Usher ..... G10L 25/78 381/57
2015/0304769 A1* 10/2015 Weijand ..... H04R 29/001 381/123
2015/0379994 A1* 12/2015 Goldstein ..... G06F 21/10 704/260
2016/0007110 A1* 1/2016 Silvestri ..... H04R 1/2849 381/380
2016/0066110 A1* 3/2016 Shennib ..... H04R 25/652 381/328
2016/0094904 A1 3/2016 Yuen
2018/0146279 A1* 5/2018 Wang ..... H04R 1/1091
2018/0221209 A1* 8/2018 Ogut ..... H04R 1/1083
2020/0186906 A1* 6/2020 Birch ..... H04R 1/1041

OTHER PUBLICATIONS https: //www.livescience.com/14150-earbud-listener-fatigue-solved.html, date unknown, author unknown.

https:// www.businessinsider.com/why-there-are-extra-holes-in-your-apple-headphones-2017-6, Stacey Leasca, Travel & Leisure, Jun. 14, 2007.

* cited by examiner

PRESSURE EQUALIZING EARPHONE

PRIORITY

The present application claims the benefit of domestic priority based on U.S. Provisional Patent Application 62/949,407 filed on Dec. 17, 2019, the entirety of which is incorporated herein by reference.

BACKGROUND

With the proliferation of hand-held phones and music players, the transmission of sounds to the user has taken on important significance. If the speakers are not able to deliver high quality sound to a user in a comfortable, healthy, private, and/or isolated manner, then the experience of listening to those transmitted sounds is less than ideal.

A conventional earphone and/or each of a pair of earphones includes a transducer that converts an electrical signal into an acoustic signal. The acoustic signal is transmitted through a closed body enclosure that is made up of an acoustic chamber, transducer, front port, nozzle, and ear coupling. The ear coupling may typically be either a foam cushion, such as over-the-head headphones that employ foam cushions for creating a snug fit to the head and acoustic isolation, or an ear tip fabricated from various elastomer materials, such as inner ear earphones with elastomer ear-tips that are directly inserted into an ear canal. Another type of 'ear bud' style earphone design is one where the earphone is placed within intra-concha region of the ear, such that there is a reduced or non-existing nozzle and the housing makes direct contact with the concha without the need for any interfacing cushions or ear-tips. The 'Earbud' types of Intra-concha earphones are not specifically designed to block/occlude external sounds or provide any significant reduction in environmental noise. Rather, their primary focus is to provide a comfortable fit for the user. As a result, some intra-concha devices are designed with a soft mushroom-shaped tip that is intended to span and only partially seal the outer part of ear canal.

Modern life styles include an ever-increasing use of mobile phones and audio playback devices of every type, often in less than ideal listening environments. Consequently, there is a corresponding increase in the need for the use of earphones as well. In order to facilitate private listening and/or intelligibility of the acoustic source signal it is usually advantageous to avoid or minimize contamination thereof by environmental noise. Therefore, many headphone/earphone designs implement extreme levels of acoustic isolation in order to improve performance. Among the most effective types is the in-ear monitor design because it creates an airtight seal with the ear canal and thus greatly reduces the amount of external sounds or noise that is able to enter and reach the eardrum.

However, in-ear monitors and other earphones that create a sealing or an occlusion of the ear canal have several disadvantages. For example, the created seal can often result in a slight mechanical offset of the eardrum from its normal rest position due to the creation of either negative, or more likely positive, static air pressure. This condition often arises when the earphone is first inserted as an airtight seal often forms between the earphone and the walls of the ear canal before the air that would otherwise be displaced can escape. Thus, the middle ear is exposed to artificially high levels of static air pressure for extended periods. Also, when an occlusion is present, voice sounds become louder and more resonant, and often a user can hear their own footsteps or heartbeat. This can make the earphones difficult to use during walking or exercising. In addition, what are often high levels of sound pressure can be generated by the transducer itself within the earphone, and a condition is created wherein the majority of users are subjected to excessively high levels of auditory stress and listening fatigue. Longer periods of exposure to such conditions can even result in a temporary reduction in hearing sensitivity and possibly even permanent hearing damage.

To overcome this problem with the earphones that create a sealing of the ear canal, attempts have been made to form the earphone with a small air vent that is ostensibly intended to serve as a mechanism for facilitating the release of static air pressure within the ear canal. The design, however, is only effective for addressing the playback of relatively loud acoustic signals generated by the earphone transducer itself and does not address the static pressure problem. In addition, since the vent area in these earphones must be restricted to very small values in order to avoid significant loss of bass extension and overall sound output to the eardrum, airflow resistance through the vent will necessarily be high. Therefore, the volume of air that the vent will pass will be significantly restricted as well, which further reduces its effectiveness.

There is therefore a need for an earphone that can create a sealing of the ear canal without loss of audio performance, such as sound quality, health, or comfort. There is further a need for an earphone with a venting mechanism that can equalize pressure without sacrificing audio performance.

SUMMARY

The present invention satisfies these needs. In one aspect of the invention, an improved earphone is disclosed.

In another aspect of the invention, an improved earphone creates an at least partial sealing of the ear canal and a venting mechanism that equalizes pressure across the seal.

In another aspect of the invention, an improved earphone creates an at least partial sealing of the ear canal and a venting mechanism that equalizes pressure across the seal without loss of audio performance, such as sound quality, health, or comfort of the user.

In another aspect of the invention, an improved earphone has a venting mechanism having an air conduit that maintains audio performance by having a selected and desired air volume and/or air flow rate therethrough.

In another aspect of the invention, an earphone comprises a body housing a transducer that is capable of generating an acoustic signal and directing the acoustic signal to an outlet in the body, the body being positionable in, on, or near an ear of user so that the acoustic signal can be directed into the ear canal of the user; an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit is sized and shaped so as to provide an improved audio performance over an earphone without the air conduit.

In another aspect of the invention, an earphone comprises a body housing a transducer that is capable of generating an acoustic signal and directing the acoustic signal to an outlet in the body, the body being positionable in, on, or near an ear of user so that the acoustic signal can be directed into the ear canal of the user; an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit has an average diameter or equivalent cross-sectional dimension of from about 0.075 mm to about 0.125 mm and wherein the air volume in the air conduit ranges from about 5 microliters to about 200 microliters.

In another aspect of the invention, an earphone comprises a body housing a transducer that is capable of generating an acoustic signal and directing the acoustic signal to an outlet in the body, the body being positionable in, on, or near an ear of user so that the acoustic signal can be directed into the ear canal of the user; an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit has an average diameter or equivalent cross-sectional dimension of from about 00.475 mm to about 0.525 mm and wherein the air volume in the air conduit ranges from about 50 microliters to about 700 microliters.

In another aspect of the invention, a method of improving audio performance from an earphone comprises at least partially creating a seal between an earphone and an ear canal and venting air across the seal to equalize pressure.

In another aspect of the invention, a method of improving audio performance from an earphone comprises at least partially creating a seal between an earphone and an ear canal and venting air across the seal with a venting mechanism having a selected and desired air volume and/or air flow rate therethrough.

In another aspect of the invention, a method of improving audio performance from an earphone comprises providing a body housing a transducer that is capable of generating an acoustic signal and directing the acoustic signal to an outlet in the body, the body being positionable in, on, or near an ear of user so that the acoustic signal can be directed into the ear canal of the user; coupling the earphone to an ear, the coupling including a sealing mechanism with a sealing member that is adapted to contact a portion of the ear of the user to at least partially create a seal between the ear canal and the external environment; and venting air across the seal with a venting mechanism, the venting mechanism comprising an air conduit that is adapted to communicate on one end with the ear canal and at another end with the external environment so that air can flow through the conduit to equalize a pressure differential across the sealing mechanism, wherein the air conduit is sized and shaped so as to provide an improved audio performance over an earphone without the air conduit.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to an earphone. In particular, the invention relates to an earphone with a venting mechanism. Although the earphone is illustrated and described in the context of being useful for the administration of sound to the ear canal, the present invention can be useful in other instances. Accordingly, the present invention is not intended to be limited to the examples and embodiments described herein.

Figure 1:
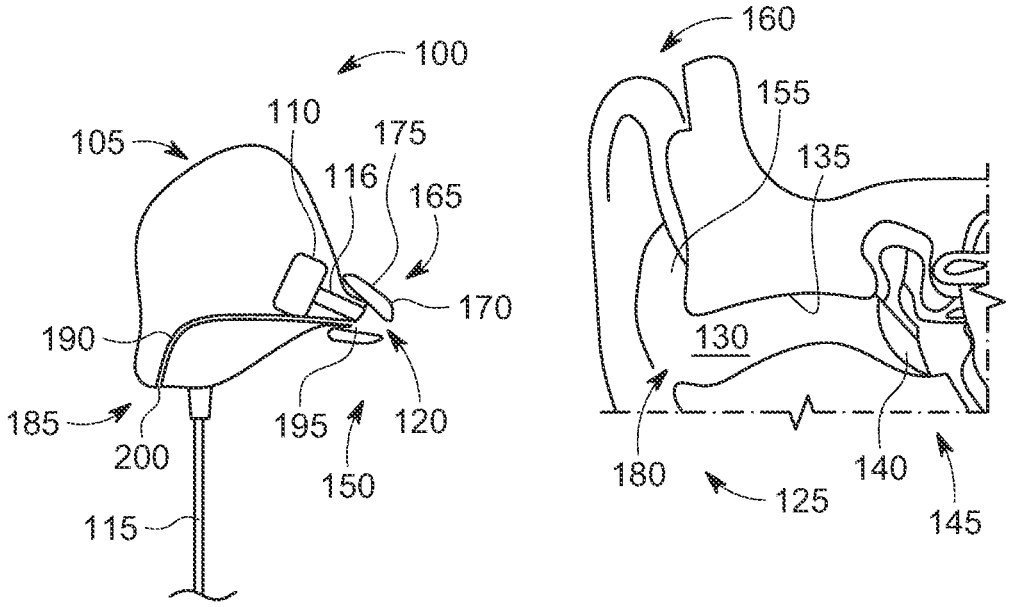
FIG. 1 is a schematic side view of an earphone according to the present invention.

FIG. 1 shows a version of an earphone 100 of the present invention. The earphone 100 may be a single earphone or one of a pair or more of earphones. The earphone 100 is made up of a body 105 that houses a transducer 110. The transducer 110 converts electrical signals into acoustic signals. For example, the body 105 may house a transducer 110 that may be one or more various known transducers that receives an audio electrical signal from a cable 115 and converts the audio signal into sound, as in known in the art. Alternatively, the transducer 110 may receive a wireless audio signal and convert the wireless audio signal into sound, as is known in the art. The transducer 110 generates the sound and directs the generated sound outwardly from the interior of the body 105 though an acoustic chamber 116 and towards an outlet port 120 at the front of the body 105. The earphone 100 is sized, shaped, and designed so that it may be positioned in or on an ear 125 of a user so that sound is directed from the outlet port 120 to an ear canal 130. By front it is meant the side of the earphone 100 that is to be inserted into or into proximity with the ear 125. The ear canal 130 has side walls 135 that define a passageway leading from outside the ear 125 to an ear drum 140 and the rest of the middle and inner ear 145. The sound from the outlet port 120 travels through the ear canal 130 and is received by the ear drum 140 where the sound can be interpreted by the user though the user's auditory system.

The operational structure and components of the earphone 100 may take any of several various forms. By earphone it is meant any sound transmitting device that includes an outlet port 120 whereby sound is directed towards or directly into the ear canal. The earphone 100 may, for example, be in the form of an over-the-head earphone that includes foam cushions to create a snug fit to the head and to provide acoustic isolation. Alternatively, the earphone 100 may include an ear coupling mechanism 150 so the earphone 100 can be held in place without the need for an over-the-head mechanism. In one version of an earphone 100 with an ear coupling mechanism 150, the ear coupling mechanism 150 includes a portion of the body 105 or other member that is sized and shaped to be received within the intra-concha 155 region of the ear's auricle 160. These types of earphones 100 with an ear coupling mechanism 150 that fits within the intra-concha 155 are often referred to as ear buds. In this version, the ear coupling mechanism 150 can be merely the shape of the body 105 or can include additional features, such as an ear hook, that help couple the earphone 150 to the ear 125. In another version of an earphone 100 with an ear coupling mechanism 150, the earphone is in the form of a inner-canal earphone where the earphone 100 is at least partially inserted into the ear canal 130 and is held there by elastomeric eartips which form at least part of the ear coupling mechanism 150. The inner-canal type of earphones are sometimes referred to as in-ear monitors (IEM's) or sometimes they are just referred to as earphones or earphones with eartips.

In one particular version, the earphone 100 includes an ear coupling mechanism 150 that comprises a sealing mechanism 165. The sealing mechanism 165 includes a sealing member 170 that can contact a portion of the ear 125 to at least partially create a seal between the ear canal 130 and the exterior environment. The sealing mechanism 165 creates the at least partial seal by having an exterior surface 175 of the sealing member 170 contact the ear 125 in a manner where air is hindered or prevented from easily passing around the exterior surface 175 when the earphone is coupled to the ear 125. The sealing mechanism 165 serves to help promote private listening to the sound. By creating the at least partial seal around the exterior, the sound is contained within the interior of the sealing member and thus is made substantially only available to the wearer of the earphone 100. In addition, the at least partial seal can serve to keep external sounds away from the ear canal 130 of the wearer so that the wearer is subjected substantially only to the sounds coming from the earphone 100. The portion of the ear that is contacted by the sealing member 170 can be either exterior to the ear canal 130 or within the ear canal 130. For example, in one version, the sealing member 170 can contact the ear 125 at the opening 180 of the ear canal 130, just outside the opening 180 of the ear canal 130, or just within the opening 180 of the ear canal 130. In another version, the sealing mechanism 165 is in the form of an ear tip that is insertable into the ear canal 130. An ear bud type of earphone 100 that has a sealing mechanism provides a partial seal and helps to privatize and isolate the sounds from the earphone 100 whereas the eartip type of earphone 100 that is inserted into the ear canal 100 more substantially reduces the amount of external sounds that are allowed to reach the eardrum and the amount of earphone sound that can be heard by others. By at least partially creating a seal it is meant that in the absence of an addition venting mechanism, a pressure differential across the seal can be maintained for at least a few seconds and more preferably at least a few minutes. While as a practical matter some air will naturally flow around the seal from the side of higher pressure to the side of lower pressure, the at least partially created seal creates a sufficiently strong seal that the movement of air is slowed or hindered enough to allow for a noticeable pressure differential in the absence of an additional venting mechanism.

As also shown in FIG. 1, the earphone 100 may be provided with a venting mechanism 185. The venting mechanism 185 provides a vent or air passageway that extends from an area of the earphone 100 in proximity to the outlet port 120 and/or the front of the earphone 100 to an area away from the outlet port 120 and/or to an area more towards the rear of the earphone 100 or on a side other than the front. Thus, when the earphone 100 is coupled to the ear 125 of a wearer and when a sealing mechanism 165 creates at least a partial seal around the exterior surface 175 of the sealing member 170, the venting mechanism 185 provides a manner in which air can pass from the sealed ear canal 130 to the external environment or the environment on the opposite side of the seal from the ear canal 130. In the particular version of FIG. 1, the venting mechanism 185 comprises an air conduit 190 having a first opening 195 at the front of the earphone 100 and a second opening 200 rearward of the front opening 195. When the earphone 100 of FIG. 1 is installed in the ear 125 and the sealing mechanism 165 creates a seal by contacting the ear 125, the first opening 195 is positioned on one side of the seal, and the second opening 200 is provided on the other side of the seal. Thus, the sealing mechanism 165 creates an at least partial seal by creating the at least partial seal, as defined above, at the periphery of the earphone 100 where the earphone 100 contacts the ear 125 of the user so that a majority of the air flow resulting from a pressure differential is through the venting mechanism 185 as opposed to flow around the seal. In this manner, the venting mechanism 185 allows for an equalization of the pressure between the ear canal 130 and the external environment. By equalization it is meant that the pressure differential lessens.

The provision of an earphone 100 that has both a sealing mechanism 165 and a venting mechanism 185 provides for an improved earphone 100 and audio transmitting system. Without the venting mechanism 185, the sealing of the ear canal can result in the creation of negative or positive static air pressure. This static air pressure can cause a slight mechanical offset of the eardrum from its normal rest position. This condition arises conventionally when an at least partially sealed earphone without a venting mechanism 185 is initially inserted in an ear. The at least partial seal forms between the earphone and the wall 135 of the ear canal 130 before the air that would otherwise be displaced can escape. Thus, the middle ear is exposed to artificially high levels of static air pressure for extended periods. In addition, the sound that is generated under this condition can create what are often high levels of sound pressure generated by the transducer 110 itself within the earphone body 105, resulting in a condition where many users are subjected to excessively high levels of auditory stress and listening fatigue. Longer periods of exposure to such conditions can even result in a temporary reduction in hearing sensitivity and possibly even permanent hearing damage.

However, with the venting mechanism 185 these problems can be reduced or eliminated. The earphone 100 of FIG. 1 provides a mechanical system and method that allows for the maintenance of the at least partial seal between the earphone 100 and the wall 135 of the ear canal 130 without the need to sacrifice audio performance. In addition, the venting mechanism 185 can also prevent the build-up of undesirable static air pressure that is commonly encountered with the types of earphones when the at least partial seal is established in or near the ear canal 130. At the same time, the earphone 100 can maintain the desirable and sought-after levels of occlusion, noise reduction, and/or sound isolation that typical in-ear monitors are known to provide. Furthermore, it is believed that with the earphone 100 of FIG. 1 hearing health is better maintained and/or the risk of damage to the auditory system is reduced.

In one version, the earphone 100 comprises a venting mechanism 185 that is dimensioned and/or oriented to provide improved performance. For example, in addition to providing the relief of pressure within the ear canal 130 as discussed above, the venting system 185 can include an air conduit 190 that is sized to achieve improved sound quality. The shape, size, and cross-sectional area of the air conduit 190 can be selected to achieve a desired mass and/or volume of air. The air mass with the air conduit 190 is a function of the conduit's cross-sectional area and length. In addition, the mass and/or volume of air within the air conduit 190 can be balanced against the flow resistance within the air conduit to result in a desired sound quality. For example, if a combination of variables is permitted where the air mass within the air conduit is low and the air flow resistance through it is high, the bass component of the sound can be negatively influenced and/or attenuated. Therefore, the dimensions of the air conduit 190 can be selected to accommodate the desired rate of the air flow through the air conduit 190 as a function of time. One parameter relative to air mass and/or volume in the air conduit 190 is airflow resistance in the air conduit 190. Specifically, the parameter of air mass is frequency dependent and reactive, in that it stores energy, and is therefore "non-dissipative." Conversely, airflow resistance is non-frequency dependent and non-reactive/dissipative, and it dissipates energy as waste heat. Therefore, airflow resistance can be a variable that can influence the behavior of the system within the desired range of system time constants.

The air conduit 190 creates a system within the earphone 100. The system comprises (i) the volume of air trapped within the ear canal between the outlet port 120 of the earphone 100 and the eardrum, and (ii) the flow rate, which is the velocity of a given volume of air flowing through the air conduit 190 within a given period of time during the operation of the earphone 100. By flow rate it is meant the amount of time it takes for an instantaneous (i.e., infinite rate) change or "step" increase/decrease of the pressure trapped within the ear canal with respect to that of the ambient air pressure, to transition from one static value to another. Thus, the air conduit 190 can be shaped and sized so that the volume of air within the air conduit 190 and/or the flow rate of air through the conduit provide improved sound quality over an earphone 100 without the air conduit 190 or other venting mechanism 185. More particularly, the air conduit 190 dimensions can be selected such that the system time constant is limited to be between about 200 milliseconds and about 1 second. The dimensions of the first opening 195 and/or the second opening 200 can be selected to achieve desired dimensions in a process of establishing the desired system time constant. The system time constant is the amount of time it takes for the pressure of the air trapped within the ear canal to become equal to that of the ambient air pressure external to the earphone device. Equalization occurs via a process of the trapped air leaking through the air conduit 190. The direction of air flow can be out of the ear canal, or into it, depending on whether the trapped air pressure within is positive or negative with respect to that of the ambient air pressure of the external environment. Furthermore, the ingress and egress of air through the air conduit 190 will vary on a moment-by-moment basis and at a rate that can always be longer but not shorter than the system time constant. In addition, a substantial portion of motional energy vis-a-vis the air passing through the air conduit 190 can be lost or converted into waste heat. Therefore, the system can be overdamped so as to inhibit/circumvent the development of a resonant condition from arising within the ear canal.

By having an air conduit sized and shaped to provide the desired air mass, excessively long time-constants can be avoided that would potentially be present in smaller air conduits. The reduced time-constants can reduce the change of the build-up of undesirable air pressure within the ear canal. During these relatively long intervals that would result from smaller air mass in the air conduit 190 and due to the asymmetric nature of the audio waveforms that give rise to them, when integrated over time the static pressure can easily take the form of a non-zero value for extended periods. By reducing the time constant with the venting system 165, the time will be shortened for the creating of zero pressure differential between the external ambient air pressure and that trapped inside the ear canal. Since the integrated values of acoustic pressures resulting from musical passages and human speech, etc. can be on the order of hundreds to as little as tens of milliseconds, a dynamic offset of the eardrum from its natural rest position is less likely to occur on a frequent basis. Likewise, the reduced pressure will improve eardrum and middle ear function and health.

Thus, the earphone 100 of FIG. 1 exhibits the ability to more thoroughly reduce and/or eliminate the build-up of static air pressure within the ear canal regardless of their source, and do so without any concomitant loss of bass extension or other performance parameters within the audio band.

The earphone 100 of FIG. 1 provides for the improvement in the resulting audio performance, such as the perceived sound quality of the earphone 100, the comfort level for the user, and/or the health benefits of the earphone 100. As a result of equalizing the external and internal air pressures on either side of the transducer 110, any offsets thereof similar to those previously identified as occurring with the eardrum will be reduced or eliminated. Such dynamic offsets can induce even-ordered harmonic distortion artifacts during the operation of any dynamic driver, so the reduction or elimination thereof will inevitably reduce the levels of distortion that the earphone 100 would otherwise generate. In addition, the pressure release and/or equalization resulting from application of the venting mechanism 185 will also improve the time-domain performance and transient response of the earphone/driver assembly. Specifically, the impulse response will be improved such that the decay-time of the transducer 110 will be reduced along with any subsequent ringing or resonant artifacts. Therefore, the dynamic speed and impact of percussive sounds and musical instruments will be rendered with a more natural, lifelike presentation and greater realism.

As wireless technology advances there is also the ongoing demand that earphones be made smaller and more convenient to use. This is particularly true with respect to the latest wireless Bluetooth earphones. One development is a class of Bluetooth devices that are very small and fit within the intra-concha region of the ear. These devices operate completely without the need for any wires and are known as True Wireless Stereo (TWS) earphones. In order to fit the circuitry, the battery and transducer all within the very small form-factor that is required, a much smaller transducer must be employed. The most popular classes of mini transducers being used in TWS earphones are the mini dynamic transducer (normally with a 6-mm diaphragm) and the Balanced Armature transducer. TWS designs lack any significant amount of frontal area and therefore are not able to accommodate a sufficiently large front vent. However, with the earphone 110 of the present invention, the entrance to a long tube or conduit leading to the ear canal can be provided. Such conduit functions to relieve the built-up of pressure inside the ear canal 130 by creating a continuous air leak to the outside environment. The effect is similar to the function of Eustachian Tube of the human ear. Thus, the earphone 100 operates by the same natural principles as that of human hearing by relieving any pressure differential that arises within the ear canal caused by the insertion and/or operation of earphones, and thereby helps restore the eardrum back to its natural rest position.

In use, the earphone 100, ear canal 130, and eardrum 140 represent a complete system as mentioned above, with an important physical parameter being that of the volume or air trapped within the ear canal 130. The air volume will exhibit a natural quasi-resonant frequency that will be maximally damped (quality factor of 0.5 or lower) and vary somewhat depending on the physical dimensions of the complete system. With the earphone 100 of FIG. 1, the resonant frequency of the complete system will necessarily be decreased or shifted to some lower value. This effect is analogous to that of a damped resonant mechanical mass/spring system, wherein the compliance of the air trapped within the ear canal 130 acts as though it were a mechanical spring and the air volume within the air conduit 190 as a solid mass. Once kinetic energy in the form of acoustic air pressure is injected into the system by the earphone transducer 110, the combination air spring/mass system will tend to oscillate at some natural resonant frequency, similar to that of a pendulum once set in motion. Because the physical dimensions involved are extremely small compared to the actual wavelength of sound in the frequency region of concern, the complete system operates within what is known as the pressure zone. Therefore, actual standing waves cannot develop as would otherwise be the case in larger systems comprised of one or more enclosed spaces, such as that of typical rooms, sealable containers and even loudspeaker enclosures, etc.

The earphone 100 thus minimizes the resonant frequency shift and limits it to some value near or just below the lowest audible frequency of 20 Hz. In so doing the effective time-constant remains below the audio band yet as short as possible, and thereby is able to more quickly equalize whatever air pressure differentials that might develop due to the natural integration of any asymmetrical audio waveforms being reproduced by the transducer during its operation. Furthermore, because the air conduit 190 length can be relatively long, its cross-sectional area is able to be made larger as well without risking any loss of audio performance/bass extension or acoustic isolation due to the intrusion of external sounds passing through the tube/conduit assembly. Specifically, the increased air conduit 190 cross-sectional area significantly reduces airflow resistance or allows for a greater air flow volume through the length of its internal structure at air transfer rates that are longer than the time-constant of the complete system, and thereby facilitates the rate at which the earphone 100 is able to equalize any air pressure differentials that might develop during operation of the earphone 100.

The complete system thus functions as a low pass filter and thereby the earphone 100 facilitates the equalization of ear canal/external environment air pressure differentials while yet blocking the transmission of sound through the tube/conduit structure at frequencies residing above the complete system's resonant time-constant or filter corner frequency. Specifically, so long as the corner frequency of the complete system is below that equivalent to the period of a 20 Hz signal (i.e., 50 milliseconds), there can be little or no ingress of audible sound from the external environment through the air conduit 190 in an amount that is in excess of that which would otherwise occur based on the construction of the earphone 100 without the venting mechanism 185. Also, significant air pressure differentials and subsequent offsets of the eardrum that would otherwise occur are prevented from developing due to the earphone's ability to permit air to flow freely between the ear canal and the outside environment.

One or more of the above considerations can be accomplished with an earphone 100 that includes a venting mechanism 185 having an air conduit 190 appropriately dimensioned and positioned. For example, in one version, the air conduit has an average diameter or equivalent cross-sectional dimension of from about 0.05 mm to about 1.0 mm, or from about 0.1 mm to about 0.5 mm, or from about 0.1 to about 0.3 mm, or from about 0.15 mm to about 0.25 mm, or about 0.2 mm, or any other range within those ranges or using the bounds of those ranges. The design, length, and cross-sectional dimensions can, in one version, be selected to that the volume of space and thus air within the conduit between the first opening 195 and the second opening 200 is at least about 5 microliters and more preferably at least about 25 microliters. More particularly, the volume of air in the air conduit 190 can be from about 5 microliters to about 700 microliters, or from about 25 microliters to about 200 microliters, or from about 30 microliters to about 500 microliters, or from about 50 microliters to about 300 microliters, or from about 75 microliters to about 150 microliters, or about 100 microliters or any other range within those ranges or using the bounds of those ranges. In one version, the desired air volume within the air conduit 190 may be selected based on the average diameter or equivalent cross-sectional dimension of the air conduit. For example, for an air conduit 190 having an average diameter or equivalent cross-sectional dimension of from about 0.075 mm to about 0.125 mm, the air volume can range from about 5 microliters to about 200 microliters, from about 5 microliters to about 100 microliters, from about 20 microliters to about 80 microliters, or from about 50 to about 70 microliters. In another example, an air conduit 190 having an average diameter or equivalent cross-sectional dimension of from about 0.175 mm to about 0.225 mm, the air volume can range from about 30 microliters to about 200 microliters, or from about 50 microliters to about 150 microliters, or from about 80 to about 120 microliters, or about 100 microliters. In another example, for an air conduit 190 having an average diameter or equivalent cross-sectional dimension of from about 0.475 mm to about 0.525 mm, the air volume can range from about 50 microliters to about 700 microliters, or from about 100 microliters to about 600 microliters, or from about 300 to about 500 microliters. For additional examples of diameters or equivalent cross-sectional dimensions of about 0.3 mm and 0.4 mm, the desired air volumes can be extrapolated from the above. By equivalent cross-sectional dimension it is meant that in the case of non-circular cross-sections, the cross-sectional area that is generally the same as the resulting cross-sectional area resulting from the recited diameters for circular cross-sections. By way of hypothetical example, a 1 mm diameter conduit would have a cross-sectional area of about 0.8 $mm^2$ and a square shaped cross-sectional conduit would have an equivalent cross-sectional area of 0.8 $mm^2$ which would mean the length of the sides of the square is about 0.9 mm.

Figure 2A:
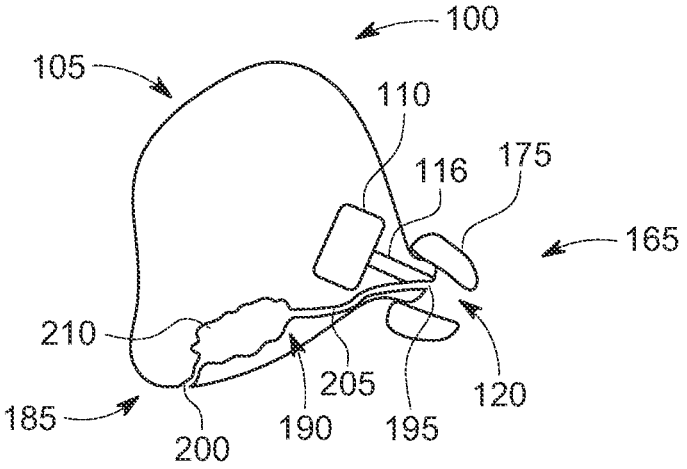
FIG. 2A is a schematic side view of another version of an earphone of the invention.
Figure 2B:
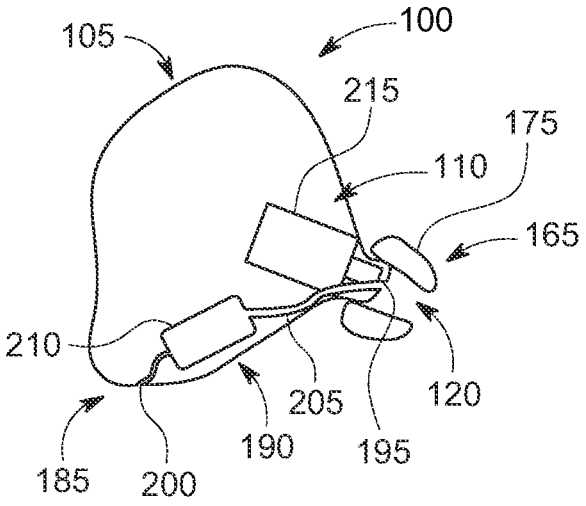
FIG. 2B is a schematic side view of another version of an earphone of the invention.
Figure 2C:
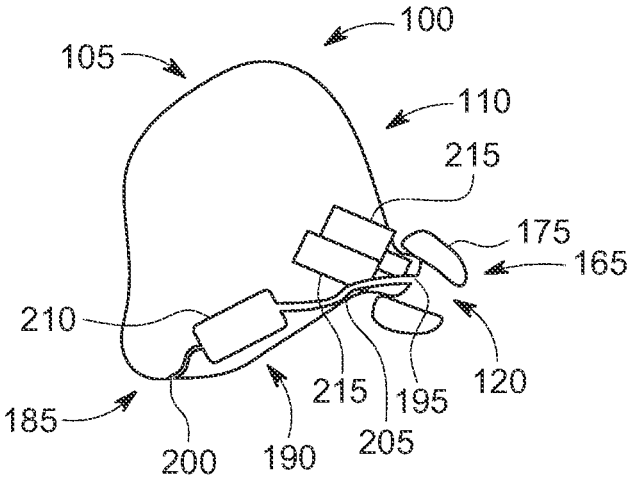
FIG. 2C is a schematic side view of another version of an earphone of the invention.

FIG. 2A shows another version of the earphone 100. In this version, the venting mechanism 185 is made up of an air conduit 190 that has two or more cross-sectional dimensions along its length. For example, in the version shown, the air conduit 190 include a tubular portion 205 having a first diameter and a cavity portion 210 having a second diameter or other cross-sectional dimension that is different than the first. In one version, such as the one shown, the second dimension is larger than the first. The cavity portion 210 may be within the body 105 of the earphone 100 or may be in a separate part that is connectable or otherwise in communication with the earphone 100. FIG. 2B shows a venting mechanism 185 similar to FIG. 2A in an earphone 100 having a transducer 110 in the form of a Balanced Armature transducer 215 with a tube. FIG. 2C shows the same with multiple Balanced Armature transducers 215.

Figure 3A:
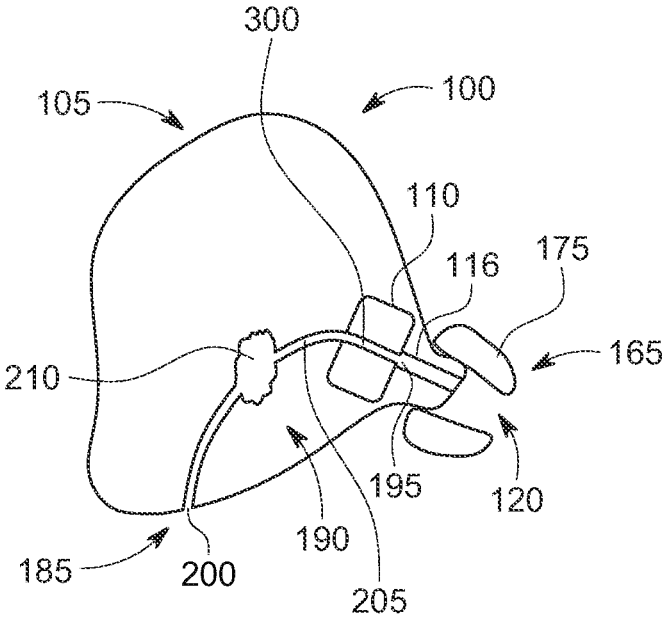
FIG. 3A is a schematic side view of another version of an earphone of the invention.
Figure 3B:
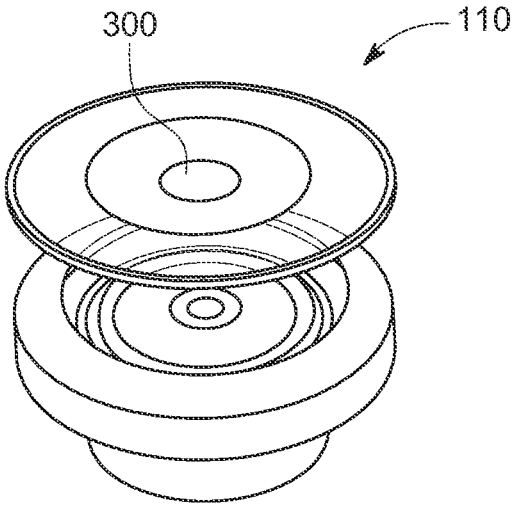
FIG. 3B is a schematic perspective view of the transducer of the version of FIG. 3A.

FIG. 3A shows another version of the earphone 100. In this version, the venting mechanism 185 includes an air conduit 190 that is incorporated into the transducer 100. Accordingly, in this version, the air conduit includes a transducer portion 300 that passes through the transducer 110. FIG. 3B shows a version of a transducer 110 with the air conduit portion 300.

Figure 4:
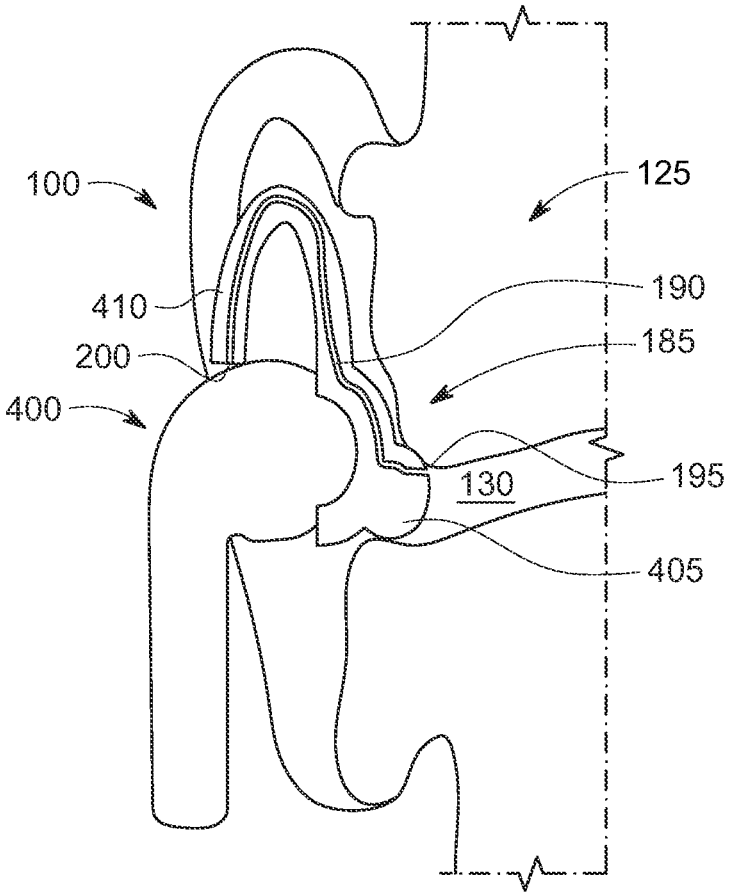
FIG. 4 is a schematic side view of another version of an earphone of the invention.

FIG. 4 shows a version of an earphone 100 in the form on an earbud 400. Earbuds are more susceptible to environmental noise because they lack significant sound isolation. This can be improved by adding an air-sealing sleeve 405 that extends into the ear canal 130 and that provides additional sound blockage. In addition, the earbud 400 can incorporate the air conduit 190 of the venting mechanism 185 within the sleeve and running along the inside of the standard ear-hook 410.

For all of the above versions and for all of the above ranges, the venting mechanism 185 can comprise a single air conduit 190 or the air conduit can be made up of two or more conduits. When two or more air conduits are provided, the dimensions of the air conduits can be such that the sum of the average diameter or equivalent cross-sectional dimension, the average cross-sectional area, and/or the air volumes falls within the above-stated ranges or the geometric equivalents of those ranges.

The air conduit 190 may be provided in any suitable manner. For example, the air conduit 190 can be drilled or otherwise provided in the body 105 of the earphone 100 or other portion or accessory. The air conduit may have sidewalls made of the same material as the earphone 100 or accessory or may be made of a different material. For example, in one version, a metal tube may be inserted into the earphone 100 and the metal tube may serve as the air conduit 100. The metal tube may be made of stainless steel or any suitable metal material. In another version, the tube may be made out of plastic, ceramic, or the like.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Therefore, any appended claims should not be limited to the description of the preferred versions contained herein and should include all such alterations, permutations, and equivalents as fall within the true spirit and scope of the present invention.

What is claimed is:

1. An earphone comprising:

a body housing a transducer that is capable of generating an acoustic signal and directing the acoustic signal to an outlet in the body, the body being positionable in, on, or near an ear of user so that the acoustic signal can be directed into the ear canal of the user;

an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit has an average diameter or equivalent cross-sectional dimension of from about 0.05 mm to about 1 mm and wherein the air volume in the air conduit ranges from about 5 microliters to about 700 microliters whereby the air conduit is sized and shaped so as to reduce the buildup of static air pressure within the ear canal of the user.

2. An earphone according to claim 1 wherein the air conduit is sized and shaped so that the volume of air within the air conduit or the air flow rate through the conduit provides the reduction in buildup of static air pressure within the ear canal of the user without substantial loss of audio performance.

3. An earphone according to claim 1 wherein the air conduit has a volume of at least about 25 microliters.

4. An earphone according to claim 1 wherein the air conduit has a volume of from about 25 microliters to about 200 microliters.

5. An earphone according to claim 1 wherein the air conduit has an average diameter or equivalent cross-sectional dimension of from about 0.075 mm to about 0.125 mm and wherein the air volume in the air conduit ranges from about 5 microliters to about 200 microliters.

6. An earphone according to claim 1 wherein the air conduit has an average diameter or equivalent cross-sectional dimension of from about 0.475 mm to about 0.525 mm and wherein the air volume in the air conduit ranges from about 50 microliters to about 700 microliters.

7. An earphone according to claim 1 wherein the venting mechanism is independent of the sealing mechanism.

8. An earphone according to claim 1 wherein the sealing mechanism is on the outside of the body and wherein the air conduit is separate from and interior to the sealing mechanism.

9. An earphone according to claim 1 wherein the venting mechanism is independent of and separate from any audio signal generation components of the earphone.

10. An earphone according to claim 1 wherein the air conduit has a varying cross-sectional dimension across its length.

11. An earphone according to claim 1 wherein the body comprises an acoustic chamber that extends from the transducer to the outlet, the sealing member extending around the acoustic chamber and the sealing member being sized and shaped to contact the ear canal of the user.

12. An earphone according to claim 1 wherein the venting mechanism functions as a low pass filter with a corner frequency below the equivalent to the period of a 20 Hz signal.

13. An earphone according to claim 1 wherein the venting mechanism functions as a low pass filter such that for a corner frequency below that equivalent to the period of a 20Hz signal, there is little or no ingress of audible sound from the external environment through the air conduit.

14. An earphone according to claim 1 wherein the air conduit passes through the transducer.

15. An earphone according to claim 1 wherein the earphone further comprises an ear hook and wherein the air conduit runs through the ear hook.

16. An earphone according to claim 1 wherein the air conduit is made up of two or more conduits.

17. An earphone according to claim 1 in combination with a second earphone adapted to direct an audio signal to another ear canal of the user.

18. An earphone comprising:

a body housing a transducer that is capable of generating an acoustic signal and directing the acoustic signal to an outlet in the body, the body being positionable in, on, or near an ear of user so that the acoustic signal can be directed into the ear canal of the user;

an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit has an average diameter or equivalent cross-sectional dimension of from about 0.075 mm to about 0.125 mm and wherein the air volume in the air conduit ranges from about 5 microliters to about 200 microliters.

19. An earphone according to claim 18 wherein the air volume in the air conduit ranges from about 20 microliters to about 80 microliters.

20. An earphone comprising:

a body housing a transducer that is capable of generating an acoustic signal and directing the acoustic signal to an outlet in the body, the body being positionable in, on, or near an ear of user so that the acoustic signal can be directed into the ear canal of the user;

an ear coupling mechanism comprising a sealing mechanism with a sealing member that is adapted to contact a portion of the ear of the user to at least partially create a seal between the ear canal and the external environment; and a venting mechanism capable of venting air between the ear canal and the external environment, the venting mechanism comprising an air conduit that is adapted to communicate on one end with the ear canal and at another end with the external environment so that air can flow through the conduit to equalize a pressure differential across the sealing mechanism, wherein the air conduit has an average diameter or equivalent cross-sectional dimension of from about 00.475 mm to about 0.525 mm and wherein the air volume in the air conduit ranges from about 50 microliters to about 700 microliters.

21. An earphone according to claim 20 wherein the air volume in the air conduit ranges from about 300 microliters to about 500 microliters.

* * * * *